US007699271B2

(12) United States Patent
Ward

(10) Patent No.: US 7,699,271 B2
(45) Date of Patent: Apr. 20, 2010

(54) ADJUSTABLE SUPPORT FOR A RAILROAD CROSSING GATE ARM

(75) Inventor: Paul D. Ward, Goshen, KY (US)

(73) Assignee: Safetran Systems Corporation, Louisville, KY (US)

( * ) Notice: Subject to any disclaimer, the term of this patent is extended or adjusted under 35 U.S.C. 154(b) by 318 days.

(21) Appl. No.: 11/465,674

(22) Filed: Aug. 18, 2006

(65) Prior Publication Data

US 2008/0042016 A1 Feb. 21, 2008

(51) Int. Cl.
*B61L 23/00* (2006.01)

(52) U.S. Cl. ..... 246/111

(58) Field of Classification Search ..... 216/111, 216/125, 473 R, 473.1; 246/111, 125, 473 R, 246/473.1

See application file for complete search history.

(56) References Cited

U.S. PATENT DOCUMENTS 4,090,685 A * 5/1978 Pappas ..... 246/125

* cited by examiner

*Primary Examiner*—S. Joseph Morano
*Assistant Examiner*—Robert J McCarry, Jr.
(74) *Attorney, Agent, or Firm*—Cook Alex Ltd.

(57) ABSTRACT

A railroad crossing gate drive mechanism has an adjustable gate arm support in the form of a split hub mounted on the external portion of a drive shaft. A fixed section of the split hub is keyed to the drive shaft and has threaded bolt holes therein. A moveable section of the split hub mounts a gate arm connector and has arcuate slots cut on the same bolt circle as the fixed section's bolt holes. Cap screws extend through the arcuate slots and into the bolt holes. The horizontal position of the gate arm connector can be adjusted due to the loose fit afforded by the arcuate slots on the cap screws. When the gate arm connector is located in the desired horizontal position, the cap screws are tightened to lock the split hub sections together.

16 Claims, 3 Drawing Sheets

ADJUSTABLE SUPPORT FOR A RAILROAD CROSSING GATE ARM

FIELD OF THE INVENTION

The present invention generally relates to railroad crossing gates and is particularly directed to an adjustable support for a gate arm.

BACKGROUND OF THE INVENTION

The prior art sidewalk gate arm support in a railroad crossing gate is a one-piece construction and is connected to the gate operating mechanism in a fixed manner. It is keyed to the drive shaft and the drive shaft is driven by the internal gear train of the gate mechanism. Wherever the main gate arm is positioned, the sidewalk gate arm has a resulting position, with no adjustment available for the sidewalk gate arm. The sidewalk gate arm could have a slight negative or positive angle that is unacceptable to the operator of the gate. The only way to change the sidewalk gate arm position, while maintaining the main gate arm position unchanged, is to remove the sidewalk gate arm, partially disassemble the gear train and change the gear mesh by one or more gear teeth. This work is done internally to the gate mechanism. This repositioning of the gear teeth is not a fine correction and frequently results in the sidewalk gate arm changing from a positive angle to a negative angle, or vice versa, but does not achieve the position desired. This internal repositioning of the gear teeth is difficult and time consuming. Numerous tools are needed to remove the sidewalk arm, bearing cover and bearing before being able to reposition the shaft and gear.

SUMMARY OF THE INVENTION

The present invention provides an adjustable support for a railroad crossing gate arm. The adjustable support allows fine adjustment of a sidewalk gate arm to a horizontal position after the gear train has been set to place the main gate arm in a horizontal position. The adjustable support for a gate arm of the present invention is a two-piece design, utilizing a split hub. One section of the hub is keyed to the drive shaft of the gate mechanism and cannot move relative to the drive shaft. The other hub section has slotted bolt holes and is connected to the fixed hub using cap screws, steel flat washers and steel lock washers. The slotted bolt holes allow the moveable hub section to move rotationally relative to the fixed hub section. A steel weldment or casting is attached to the moveable hub and acts as the adjustable connector for the sidewalk gate arm. Adjustment is achieved by rotating the adjustable hub and arm assembly with respect to the fixed hub.

The slots allow 14° total rotational freedom of the moveable hub with respect to the fixed hub. This movement is equal to changing the gear engagement by three teeth. Adjustments can be made quickly and easily externally to the gate mechanism with no need to disassemble any internal parts of the gate mechanism at all. This design will reduce installation time and, if the need arises, can be adjusted quickly any time during installation, setup or routine periodic gate maintenance, with one tool, a ¾-inch wrench or socket.

DETAILED DESCRIPTION OF THE INVENTION

Figure 1:
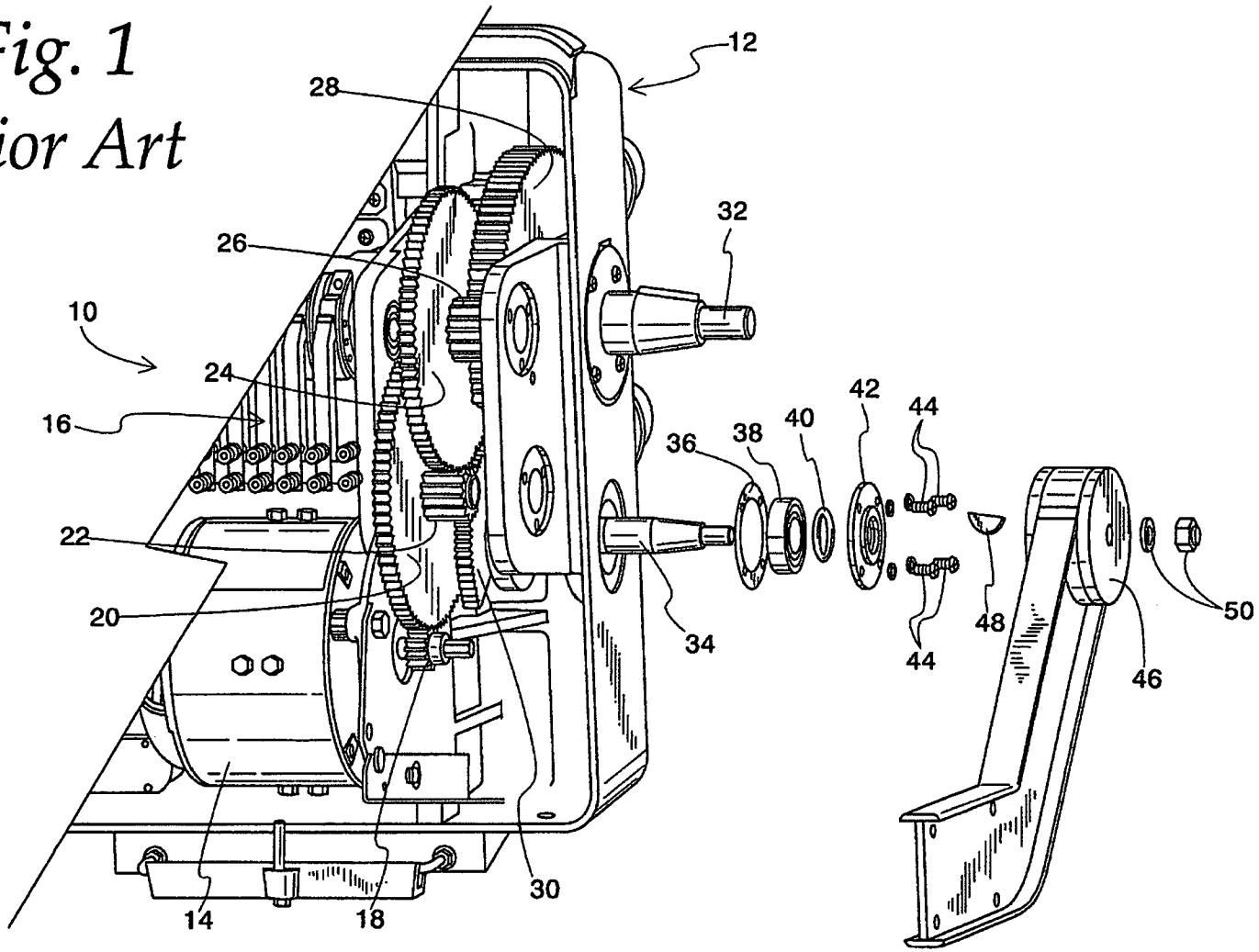
Fig. 1 Prior Art
FIG. 1 is an exploded perspective view of a prior art gate mechanism, with portions cut away and the cover removed, showing the sidewalk arm mounting.

FIG. 1 illustrates a conventional railroad crossing gate mechanism 10 and sidewalk gate arm attachment. The gate arm mechanism includes a housing 12. The cover has been removed in FIG. 1 to reveal the interior components that include a drive motor 14, a circuit controller shown generally at 16 and a drive train. In this case the drive train includes a motor pinion 18, a first reduction gear 20 and pinion 22, a second reduction gear 24 and pinion 26, segment gear assembly 28 and sidewalk drive gear 30. The segment gear assembly 28 is fixed to an interior portion of a main drive shaft, while the sidewalk drive gear 30 is fixed to a an interior portion of a sidewalk drive shaft. Both drive shafts extend through openings in the housing 12 to define exterior portions of the drive shafts, shown at 32 and 34 respectively. The segment gear assembly 28 is driven by the second reduction pinion 26 while the sidewalk drive gear is driven by the segment gear assembly.

Further details of the sidewalk drive shaft mounting are shown. These include a gasket 36, a ball bearing 38, and O-ring 40, a bearing retainer 42, and machine screws and washers 44. These components are used to mount the sidewalk drive shaft. The conventional, one-piece sidewalk gate arm support 46 is fixed to the drive shaft 34 by a woodruff key 48 and held in place by a nut and washer set 50.

These components are enumerated to illustrate the problem with the prior art support arm attachment. As can be seen by the drive train arrangement, the control circuit can be set up to control the motor 14 such that the main gate arm attains a horizontal position when it is closed. Due to the arrangement of the gear train, the sidewalk gate arm will then obtain whatever position is dictated by the engagement of sidewalk drive gear 30 with the segment gear assembly 28. The only adjustment available is to disengage the sidewalk drive gear from the segment gear assembly 28, rotate the sidewalk drive shaft 34 and drive gear combination relative to the segment gear assembly 28, and then re-engage the gears with different sets of gear teeth meshing with one another. As pointed out above, this can result in overcorrection of the problem, leaving no chance to place the sidewalk gate arm in a horizontal position when the main gate arm is in its horizontal position. Further, the disassembly of a nut 50, key 48, support 46, screws 44, retainer 42, O-ring 40, ball bearing 38, and gasket 36 is required to achieve even this coarse adjustment. All those parts must then, of course, be put back together. Overall this is a time-consuming job that will produce indifferent results. Even the most determined installer is likely to be discouraged from even attempting such a task.

Figure 2:
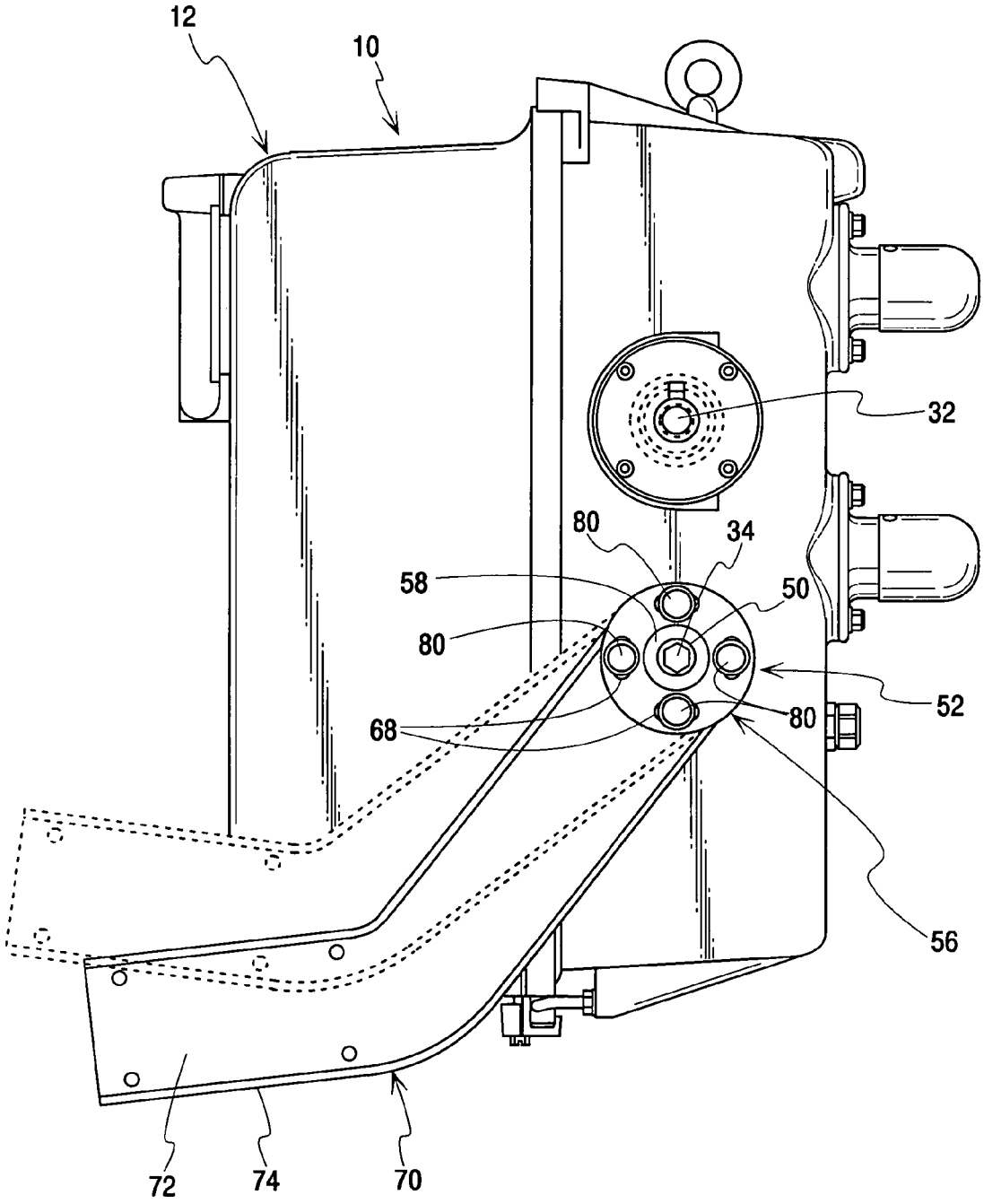
FIG. 2 is front elevation view of the sidewalk arm mounting of the present invention, showing range of adjustment available to the sidewalk arm connector.
Figure 3:
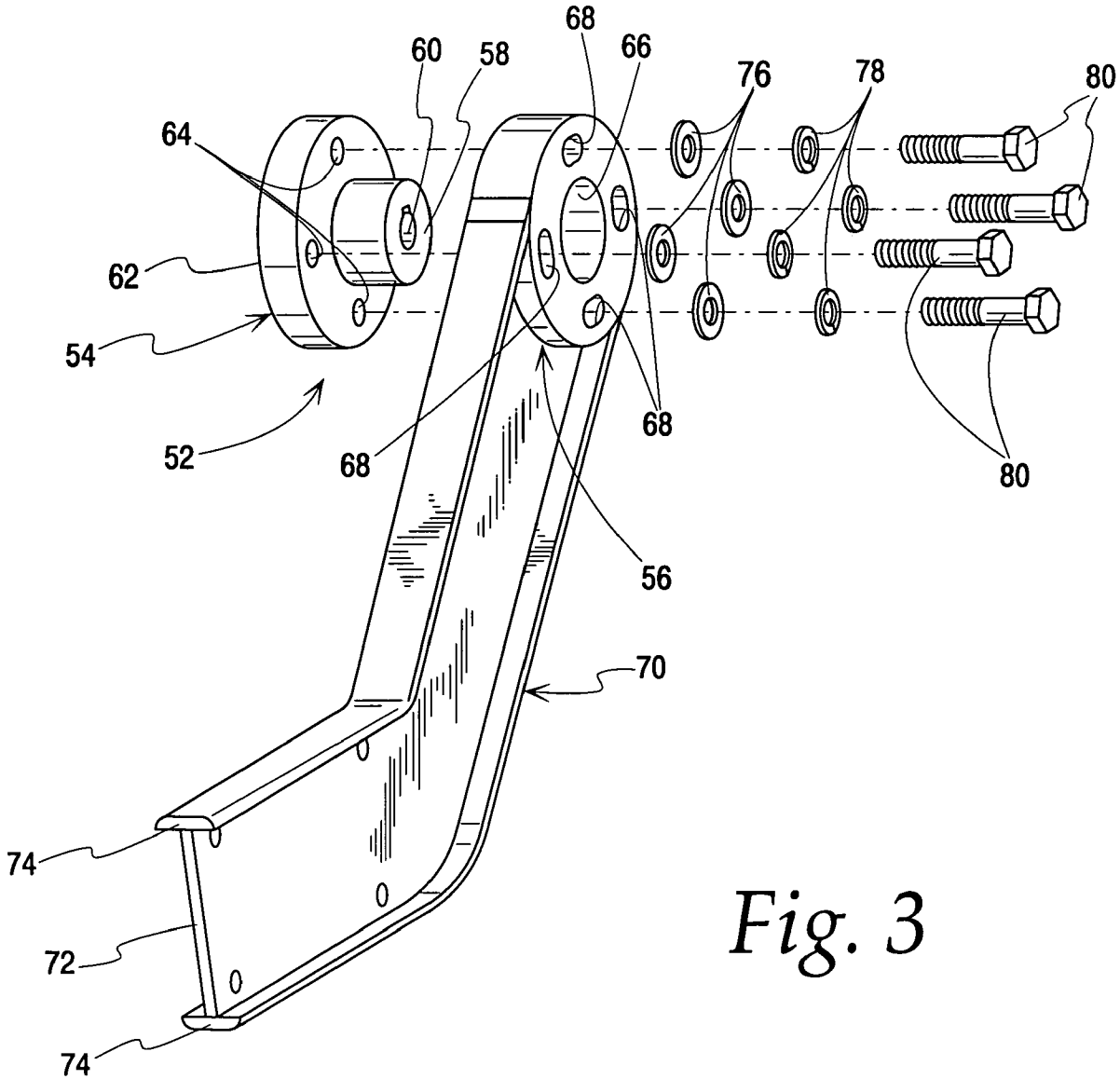
FIG. 3 is an exploded perspective view of the adjustable sidewalk gate arm support of the present invention.

The present invention overcomes these problems. FIGS. 2 and 3 illustrate the adjustable gate arm support of the present invention. It includes a split hub 52 having a fixed section 54 and a moveable section 56. These two sections are split along a vertical plane. The moveable section is connectable to the fixed section in an infinitely-selectable rotational position.

As seen in FIG. 3, the fixed section 54 has a cylindrical central hub portion 58 with a bore 60 therethrough. The bore may be keyed as shown for attachment to the exterior portion of the sidewalk drive shaft 34. At one end of the hub portion 58 there is an annular collar 62. The collar is coaxial with the hub portion. The collar has a plurality of circular bolt holes 64 drilled through it. In the illustrated embodiment there are four bolt holes, the centers of which define a bolt circle which is centered on the axis of the collar. The bolt holes 64 are internally threaded.

The moveable section 56 is an annular disk with a central bore 66 sized for receiving the hub portion 58. The disk has a plurality of arcuate slots 68 cut on the same bolt circle as the bolt holes 64 of the fixed section. Thus, the slots 68 align with the holes 64 when the sections 54, 56 are placed next to one another. A gate arm connector 70 is fixedly attached to the moveable section 56, such as by welding. The gate arm connector may be a weldment or casting having an angled plate 72 and top and bottom flanges 74. The plate may be provided with holes as shown for attachment of a replaceable gate arm extension.

The split hub 52 is assembled by placing the fixed section 54 over the end of the sidewalk drive shaft 34 and pushing the key 48 into place. With the fixed section thus locked on the sidewalk drive shaft 34 the moveable section 56 is slipped over the hub portion 58 of the fixed section 54. Washers 76 and lockwashers 78 are placed on capscrews 80. The capscrews are inserted into the arcuate slots 68 and threaded into the bolt holes 64 of the fixed section. Just before tightening the cap screws the gate arm connector is adjusted to place its free end portion in a horizontal position. The movement of the arcuate slots relative to the cap screws allows this adjustment to take place. With the free end of the gate arm connector horizontal, the cap screws 80 are tightened to lock the mating faces of the fixed section 54 and the moveable section 56 together. When adjusted to the proper position and the cap screws are tightened, the face contact area of the fixed and moveable sections provide enough friction to prevent undesired movement with over 500 ft-lbs applied to the moveable section, which exceeds AREMA main shaft torque requirements. FIG. 2 illustrates the gate arm connector 70 in solid lines in one position and in phantom lines in a second position. This shows the available adjustment is about 14°. This has been found to be an adequate range. If greater range were desired, then the arcuate slots 68 could be enlarged.

The split hub components are painted with the exception of the bolt holes, main bores and the contact faces of the fixed and moveable sections. The components may also be zinc plated, galvanized or have no finish if the material is stainless steel.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein. For example, instead of the arcuate holes in the movable hub section, the hub sections could have a plurality of radial teeth formed on their adjoining faces. Then the rotational adjustment of the movable section relative to the fixed section would be achieved by loosening the bolts, resetting the mesh of these teeth, and then retightening the bolts. Another possibility would be to clamp the fixed and movable sections together by clamps extending around the outer edges of the hub sections. Also, the above discussion has indicated the primary problem addressed by the invention is positioning of the sidewalk gate arm relative to the main gate arm. However, it will be appreciated that the invention is not limited to use with sidewalk gate arms. It could equally be applied to the main gate arm attachment as well.

I claim:

1. A railroad crossing gate drive mechanism, comprising:

a housing having a motor and gear train mounted therein;

a drive shaft having an interior portion engageable in driving relation with the gear train for rotating the drive shaft, the drive shaft extending through an opening in the housing to define an exterior portion of the drive shaft;

a split hub having a fixed section and a movable section, the fixed section being connected to the exterior portion of the drive shaft, the movable section being rotationally adjustably-connected to the fixed section for selectively adjusting the rotational orientation of the movable section relative to the fixed section, said movable section remains connected to the fixed section during adjustment of the rotational orientation of the movable section relative to the fixed section; and a gate arm attached to the movable section of the split hub.

2. The railroad crossing gate mechanism of claim 1 wherein the fixed section includes a plurality of bolt holes formed therein and defining a bolt circle.

3. The railroad crossing gate mechanism of claim 2 wherein the movable section includes a plurality of arcuate slots formed therein and located on the same bolt circle as the bolt holes of the fixed section so as to align therewith.

4. The railroad crossing gate mechanism of claim 1 wherein the fixed section includes a central hub having a bore therethrough for receiving the drive shaft and a collar attached to one end of the central hub, the collar having a plurality of bolt holes formed therein and defining a bolt circle.

5. The railroad crossing gate mechanism of claim 4 wherein the movable section includes a bore therethrough for receiving the central hub of the fixed section, the movable section further including a plurality of arcuate slots formed therein and located on the same bolt circle as the bolt holes of the collar so as to align therewith.

6. The railroad crossing gate mechanism of claim 5 further comprising a plurality of capscrews extending through aligned pairs of arcuate slots and bolt holes, the capscrews being sized to fit snugly in the bolt holes.

7. The railroad crossing gate of claim 6 wherein the bolt holes are threaded to engage the capscrews.

8. The railroad crossing gate of claim 7 further comprising a lockwasher associated with each capscrew to prevent loosening of the capscrew.

9. In a railroad crossing gate drive mechanism of the type having a housing with a motor and gear train mounted therein, a drive shaft having an interior portion engageable in driving relation with the gear train for rotating the drive shaft, the drive shaft extending though an opening in the housing to define an exterior portion of the drive shaft, the improvement comprising an adjustable attachment for a gate arm, comprising:

a split hub having a fixed section and a movable section, the fixed section being connected to the exterior portion of the drive shaft, the movable section being rotationally adjustably-connected to the fixed section for selectively adjusting the rotational orientation of the movable section relative to the fixed section, said movable section remains connected to the fixed section during adjustment of the rotational orientation of the movable section relative to the fixed section; and a gate arm connector attached to the movable section of the split hub.

10. The railroad crossing gate mechanism of claim 9 wherein the fixed section includes a plurality of bolt holes formed therein and defining a bolt circle.

11. The railroad crossing gate mechanism of claim 10 wherein the movable section includes a plurality of arcuate slots formed therein and located on the same bolt circle as the bolt holes of the fixed section so as to align therewith.

12. The railroad crossing gate mechanism of claim 9 wherein the fixed section includes a central hub having a bore therethrough for receiving the drive shaft and a collar attached to one end of the central hub, the collar having a plurality of bolt holes formed therein and defining a bolt circle.

13. The railroad crossing gate mechanism of claim 12 wherein the movable section includes a bore therethrough for receiving the central hub of the fixed section, the movable section further including a plurality of arcuate slots formed therein and located on the same bolt circle as the bolt holes of the collar so as to align therewith.

14. The railroad crossing gate mechanism of claim 13 further comprising a plurality of capscrews extending through aligned pairs of arcuate slots and bolt holes, the capscrews being sized to fit snugly in the bolt holes.

15. The railroad crossing gate of claim 14 wherein the bolt holes are threaded to engage the capscrews.

16. The railroad crossing gate of claim 15 further comprising a lockwasher associated with each capscrew to prevent loosening of the capscrew.

* * * * *